US006685433B2

(12) United States Patent
Kim et al.

(10) Patent No.: US 6,685,433 B2
(45) **Date of Patent: *Feb. 3, 2004**

(54) TURBOFAN FOR WINDOW-TYPE AIR CONDITIONER

(75) Inventors: Sung Chun Kim, Seoul (KR); Young Min Park, Incheon-si (KR)

(73) Assignee: LG Electronics Inc., Seoul (KR)

( * ) Notice: Subject to any disclaimer, the term of this patent is extended or adjusted under 35 U.S.C. 154(b) by 109 days.

This patent is subject to a terminal disclaimer.

(21) Appl. No.: 09/930,205

(22) Filed: Aug. 16, 2001

(65) Prior Publication Data

US 2002/0021967 A1 Feb. 21, 2002

(30) Foreign Application Priority Data

Aug. 17, 2000 (KR) ..... 2000/47394

(51) Int. Cl.[7] ..... F04D 29/30

(52) U.S. Cl. ..... 416/186 R; 416/223 B; 416/DIG. 2; 415/206

(58) Field of Search ..... 416/186 R, 199, 416/195, 223 B; 415/206

(56) References Cited

U.S. PATENT DOCUMENTS 3,859,009 A * 1/1975 Ballentine ..... 416/186
4,231,706 A * 11/1980 Ueda et al. ..... 416/186 R
4,927,328 A * 5/1990 Scoates et al. ..... 415/220
5,066,194 A * 11/1991 Amr et al. ..... 415/223
5,248,224 A * 9/1993 Amr ..... 415/223
5,803,721 A * 9/1998 Lee ..... 417/423.14
6,042,335 A * 3/2000 Amr ..... 415/208.1
2002/0028138 A1 * 3/2002 Lee ..... 415/206
2002/0110455 A1 * 8/2002 Kim et al. ..... 416/196 R
2002/0110462 A1 * 8/2002 Hunt ..... 417/360

* cited by examiner

*Primary Examiner*—Edward K. Look
*Assistant Examiner*—J. M. McAleenan
(74) *Attorney, Agent, or Firm*—Birch, Stewart, Kolasch & Birch, LLP

(57) ABSTRACT

A turbofan for a window-type air conditioner which includes a hub, seven to eleven blades located at a predetermined separation from the hub and gradually narrowed in their width toward the hub; and a shroud attached to the blades in opposition to the hub, wherein the entire width of the turbofan is 35–45% of an outer diameter of the blades, the exit width of the turbofan is 50–60% of the entire width, the entrance width of the turbofan is 85–92% of the entire width, the hub-side inner diameter of the blades is 45–55% of the outer diameter of the blades, and the shroud-side inner diameter of the blades is 60–70% of the outer diameter of the blades.

18 Claims, 4 Drawing Sheets

(a)

(b)

TURBOFAN FOR WINDOW-TYPE AIR CONDITIONER

BACKGROUND OF THE INVENTION

1. Field of the Invention

The present invention relates to a turbofan, and more particularly, the present invention relates to a turbofan which is applied to a window-type air conditioner.

2. Description of the Related Art

Generally, as shown in FIG. 1, a window-type air conditioner has a single case 10. In the case 10, there are arranged a compressor 12 for compressing refrigerant, a condenser 14 for condensing the refrigerant which is compressed by the compressor 12 and thereby decreasing the temperature of the refrigerant, and an evaporator 16 for performing a heat-exchanging function using the refrigerant which is reduced in terms of its temperature by the condenser 14.

A space which is defined in the case 10 of the window-type air conditioner is divided into an indoor part and an outdoor part by a partition panel 18.

The evaporator 16, a turbofan 20 for circulating room air through the evaporator 16, and the like are disposed in the indoor part. The compressor 12, the condenser 14, an axial-flow fan 30 for enabling the condenser 14 to conduct a condensing function using outside air, and the like are disposed in the outdoor part.

As shown in FIG. 2, the turbofan 20 is composed of a hub 201, a plurality of blades 202 which are located at a predetermined separation from the hub 201, and a shroud 203 which is attached to distal ends of the plurality of blades 202 in opposition to the hub 201.

The turbofan 20 is connected to a driving motor 19 in a state wherein it is disposed in a scroll case 22 which defines an air passage.

In the window-type air conditioner, warm air in a room passes through the evaporator 16 by the rotating action of the turbofan 20 and thereby is cooled. Thereafter, the cooled air is drawn into the scroll case 22. Then, the drawn-in air is compressed by the plurality of blades 202 and discharged out of the scroll case 22. In this way, the temperature of the air in the room is properly adjusted so as to cool the room.

At this time, the cooled air which is discharged from the scroll case 22 is not immediately re-sucked into the scroll case 22 thanks to a static pressure increase effect which is produced inside the scroll case 22 by the presence of the shroud 203, and instead, is dispersed over a remote region.

The refrigerant, which is raised in its temperature by being brought into contact with the warm air at the evaporator 16, is re-cooled, in the course of passing through the condenser 14, by the outside air which flows into the outdoor portion due to rotating action of the axial-flow fan 30, so as to be continuously circulated.

Here, air-blowing factors which determine the air-blowing characteristics of the turbofan 20 include combination factors which are created by the relationships among the respective blades 202, individual factors which are induced by the independent nature of the respective blades 202, and separate factors which are induced by other elements except the blades 202.

The combinative factors include, as shown in FIG. 3, a number of the blades 202, a ratio $D_1/D_2$ between a diameter $D_1$ (that is, an inner diameter of the blades) of a circle which is obtained by connecting inner ends of the respective blades 202 and a diameter $D_2$ (that is, an outer diameter of the blades) of a circle which is obtained by connecting outer ends of the respective blades 202, and a length $L_2$ (see FIG. 4*a*) of a line segment (that is, a section) which connects the outer ends of two adjoining blades 202.

The individual factors include a length $L_1$ of a line segment (that is, a chord) which connects the inner and outer ends of each blade 202 (see FIG. 4*a*), an entrance angle $\beta_1$ and an exit angle $\beta_2$ of the blade 202 (see FIG. 4*b*), a maximum camber position P and a maximum thickness t of the blade 202 (see FIG. 4*b*), and an entrance width $W_1$ which is the inner length of the blade 202 and an exit width $W_2$ which is the outer length of the blade 202 (see FIG. 5).

Here, the number of the blades 202 is determined depending upon the ratio between the length $L_1$ of the chord and the length $L_2$ of the section. The maximum camber position P designates the relative distance from a starting point of the blade 202 to a point of maximum thickness t when assuming that the length $L_1$ of the chord is 1.

The separate factors include the inner diameter Ds of the shroud 203 as shown in FIG. 5.

In the conventional window-type air conditioner, a sirocco fan (not shown) can be used in place of the turbofan.

Because the sirocco fan has a large air-blowing rate, the size of the sirocco fan can be decreased. However, when assuming that the turbofan and the sirocco fan have the same air-blowing rate, since the sirocco fan has increased power consumption in comparison with the turbofan, the sirocco fan has the disadvantage in that its operating efficiency is degraded. As a consequence, since the turbofan has a higher operating efficiency than the sirocco fan, it is mainly used in a window-type air conditioner. On the other hand, due to the fact that the turbofan occupies an increased volume when compared to the sirocco fan having the same air-blowing rate, the turbofan adversely affects miniaturization of the air conditioner.

The conventional turbofan 20 is fabricated by a joining method or an integral forming method. In the joining method, the separately formed shroud 203 is joined to the plurality of blades 202 in a state wherein the hub 201 and the plurality of blades 202 are integrally formed with each other. In the integral forming method, by configuring the hub 201 in a manner such that the diameter of the hub 201 is less than the outer diameter $D_2$ of the blade 202, the hub 201, the plurality of blades 202 and the shroud 203 are integrally formed one with the other.

However, the joining method encounters a problem in that, since a separate procedure for joining the shroud 203 to the blades 202 is needed, the productivity of the turbofan is reduced. Also, the integral forming method suffers from defects in that significant operating noise is produced due to the structural features of the turbofan.

SUMMARY OF THE INVENTION

Accordingly, the present invention has been made in an effort to solve the problems occurring in the related art, and thus an object of the present invention is to provide a turbofan for a window-type air conditioner, which is constructed in such a way as to be fabricated by an integral forming method, whereby the productivity of the turbofan is improved and at the same time, the air-blowing efficiency of the turbofan is improved.

In order to achieve the above object, according to one aspect of the present invention, there is provided a turbofan for a window-type air conditioner, comprising: a hub; seven to eleven blades located at a predetermined separation from the hub and gradually narrowed in their width toward the hub; and a shroud attached to the blades in opposition to the hub; wherein the entire width of the turbofan is 35–45% of an outer diameter of the blades, the exit width of the turbofan is 50–60% of the entire width, the entrance width of the turbofan is 85–92% of the entire width, the hub-side inner diameter of the blades is 45–55% of the outer diameter of the blades, and the shroud-side inner diameter of the blades is 60–70% of the outer diameter of the blades.

According to another aspect of the present invention, each blade has a shroud-side inclination angle of 30–60°, an exit angle of 50–65°, a hub-side entrance angle of 15–30°, a shroud-side entrance angle of 40–55°, a maximum camber position of 0.3–0.5, and a maximum thickness of 5–8% of the hub-side chord length or 7–12% of the shroud-side chord length.

According to still another aspect of the present invention, an inner diameter of the shroud is 70–80% of the outer diameter of the blades.

According to yet still another aspect of the present invention, the hub has a diameter which is less than the outer diameter of the blades.

BRIEF DESCRIPTION OF THE DRAWINGS

The above objects, and other features and advantages of the present invention will become more apparent after a reading of the following detailed description when taken in conjunction with the drawings, wherein.

DETAILED DESCRIPTION OF PREFERRED EMBODIMENTS

Figure 1:
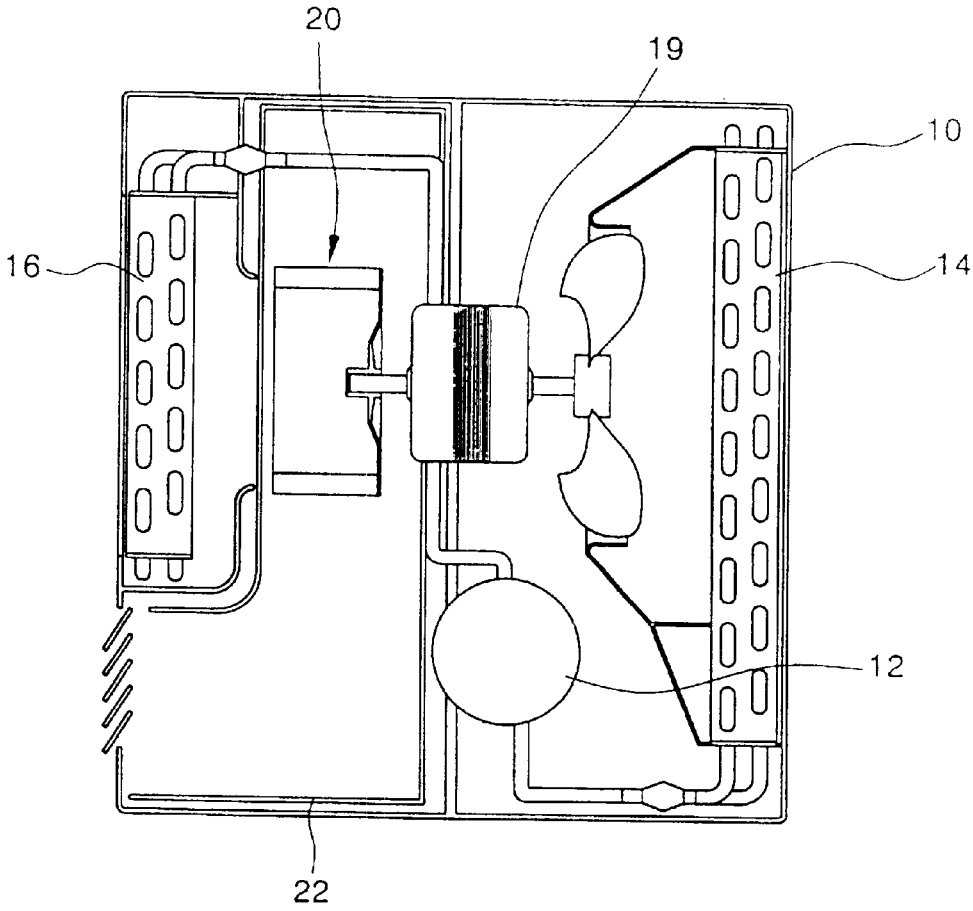
FIG. 1 is a schematic cross-sectional view illustrating the construction of a conventional window-type air conditioner.
Figure 2:
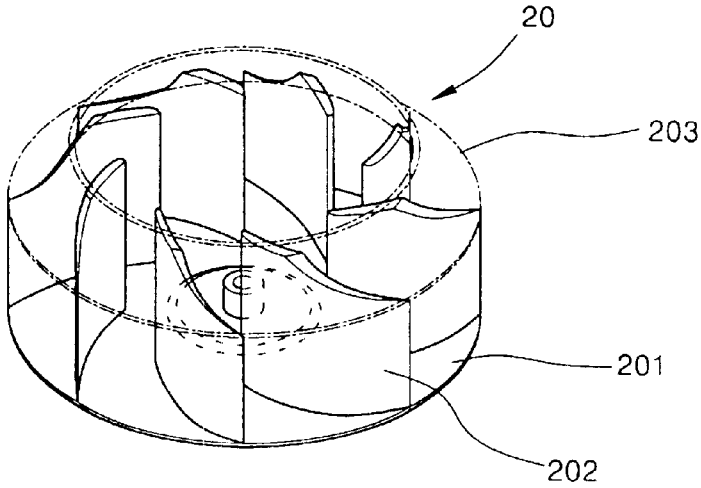
FIG. 2 is a perspective view illustrating the construction of a conventional turbofan which is applied to the conventional window-type air conditioner.
Figure 3:
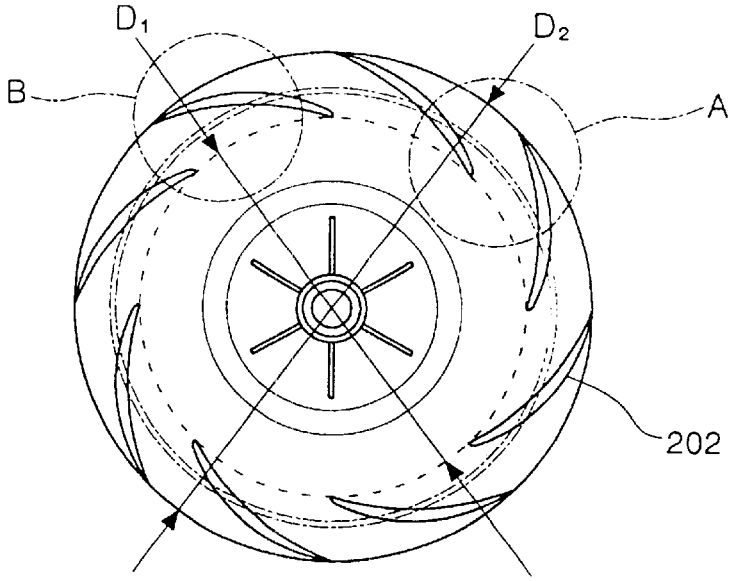
FIG. 3 is a schematic front view illustrating the construction of the conventional turbofan which is applied to the conventional window-type air conditioner.
Figure 4:
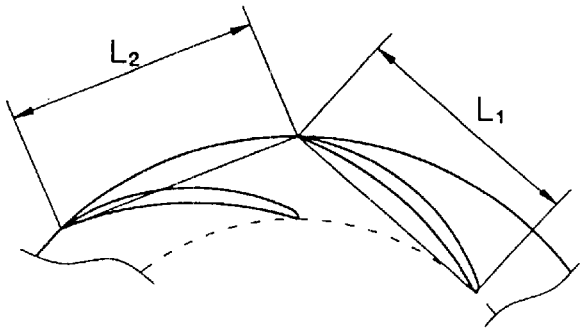
FIGS. 4*a* and 4*b* are enlarged views for the A and B portions of FIG. 3.
Figure 4:
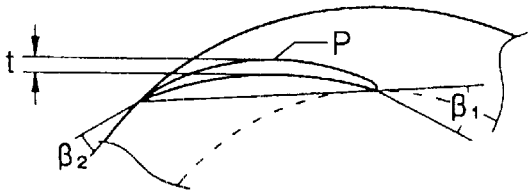
Figure 5:
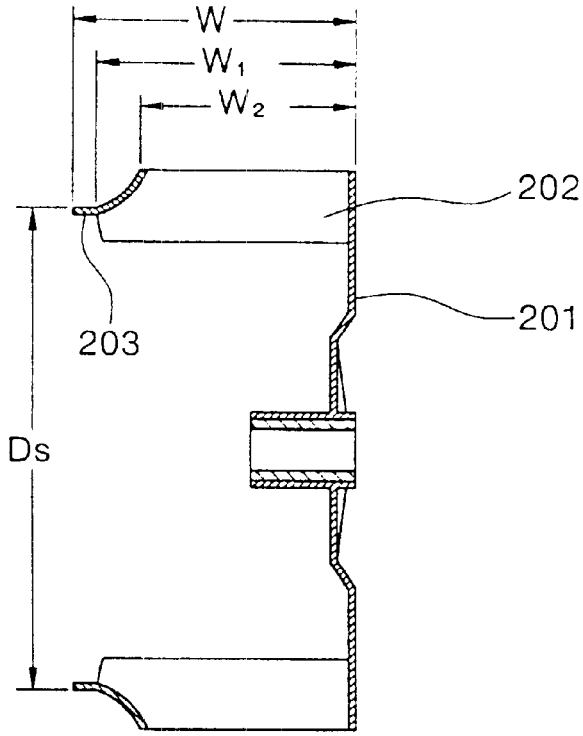
FIG. 5 is a cross-sectional view illustrating the construction of the conventional turbofan.
Figure 6:
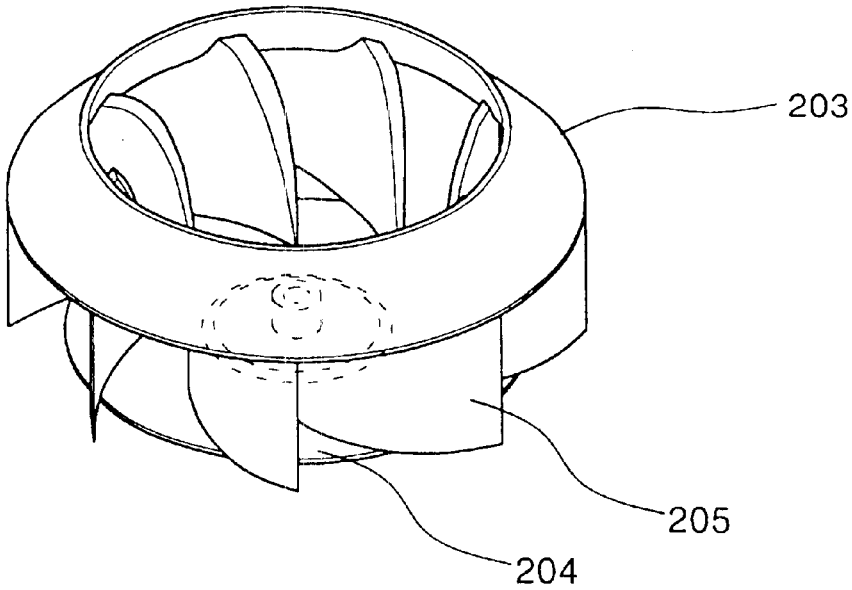
FIG. 6 is a perspective view illustrating the construction of the turbofan in accordance with an embodiment of the present invention.
Figure 7:
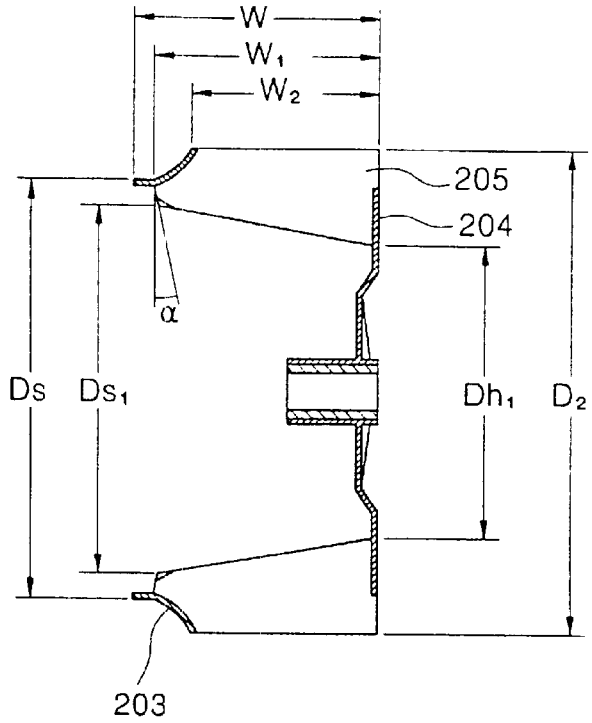
FIG. 7 is a cross-sectional view illustrating the construction of the turbofan in accordance with the present invention.
Figure 8:
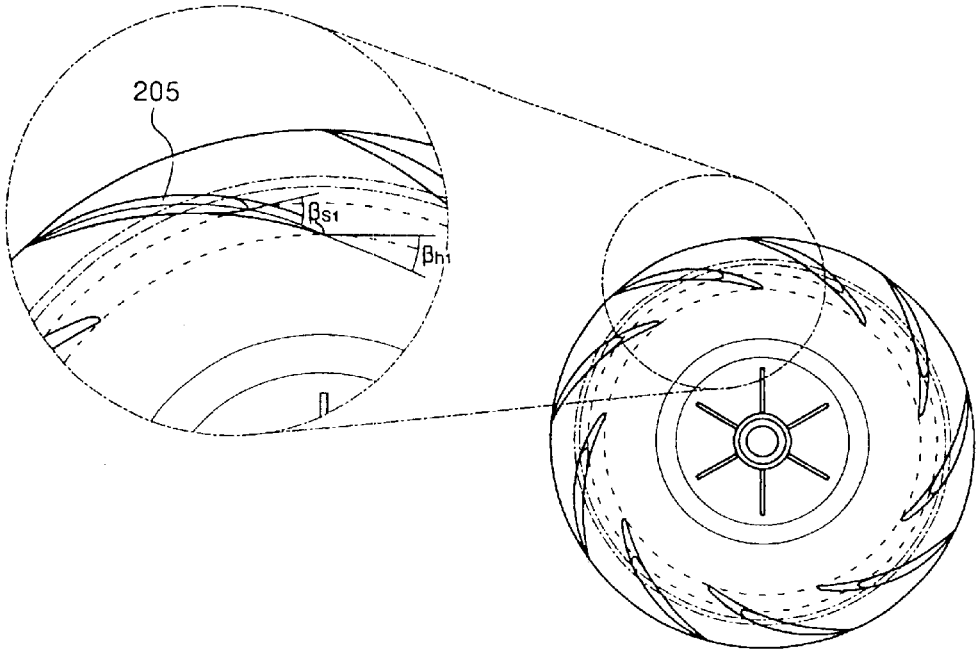
FIG. 8 is a partially enlarged schematic front view illustrating the construction of the turbofan in accordance with the present invention.

Reference will now be made in greater detail to a preferred embodiment of the invention, an example of which is illustrated in FIGS. 6 through 8. Wherever possible, the same reference numerals will be used throughout the drawings and the description to refer to the same or like parts.

As shown in FIG. 6, a turbofan for a window-type air conditioner according to the present invention includes a hub 204, seven to eleven blades 205 and a shroud 203. The blades 205 are located at a predetermined separation from the hub 204 and are gradually narrowed in their width from the hub 204 toward the shroud 203. The shroud 203 is attached to the blades 205 in opposition to the hub 204.

The turbofan according to this embodiment of the present invention has an entire width W of 35–45% of an outer diameter $D_2$ of the blades 205, an exit width $W_2$ of 50–60% of the entire width W, and an entrance width $W_1$ of 85–92% of the entire width W.

Also, the blades 205 have a hub-side inner diameter $Dh_1$ and a shroud-side inner diameter $Ds_1$ which are differentiated from each other due to structural features of the blades 205. That is to say, the hub-side inner diameter $Dh_1$ of the blades 205 is 45–55% of the outer diameter $D_2$, and the shroud-side inner diameter $Ds_1$ of the blades 205 is 60–70% of the outer diameter $D_2$.

Here, each blade 205 has a shroud-side inclination angle $\alpha$ of 30–60°, an exit angle $\beta_2$ of 50–65°, a hub-side entrance angle $\beta h_1$ of 15–30°, a shroud-side entrance angle $\beta s_1$ of 40–55°, a maximum camber position P of 0.3–0.5, and a maximum thickness t which is 5–8% of a hub-side chord length $Lh_1$ or 7–12% of a shroud-side chord length $Ls_1$.

The inner diameter of the shroud 203 is 70–80% of the outer diameter $D_2$ of the blades 205.

The hub 204 of the turbofan, according to this embodiment of the present invention, has a diameter which is less than the outer diameter $D_2$ of the blades 205, in a manner such that hub-side ends of the blades 205 project out of the hub 204.

In the turbofan for a window-type air conditioner according to this embodiment of the present invention, constructed as mentioned above, due to the fact that a ratio $Dh_1/D_2$ between the hub-side inner diameter $Dh_1$ and the outer diameter $D_2$ of the blades 205 is reduced, because the hub-side chord length $Lh_1$ of the blade 205 is increased, static pressure is raised. Further, by the fact that a ratio $Ds_1/D_2$ between the shroud-side inner diameter $Ds_1$ and the outer diameter $D_2$ of the blades 205 is increased, the suction opening is enlarged, whereby the suction efficiency is improved.

Experiments which had been implemented for the turbofan according to this embodiment of the present invention and the sirocco fan having the same air-blowing rate as the turbofan, revealed that the power consumption is reduced in the case of the turbofan by an amount of 40%. Also, it was found that operating noise is increased in the case of the turbofan according to this embodiment of the present invention by a small amount of about 0.2 dB when compared to the conventional turbofan.

Therefore, the turbofan according to this embodiment of the present invention, occupies a small volume and has a high rotational velocity when compared to the conventional turbofan. Nevertheless, the turbofan according to the present invention can exhibit the same air-blowing capability as the conventional turbofan. By the construction and operating characteristics of the turbofan according to the present invention, it is possible to miniaturize an air conditioner up to a size which is employed when using the sirocco fan.

In addition, in the turbofan for a window-type air conditioner, according to this embodiment of the present invention, because the blades 205 project out of the hub 204, it is possible to integrally fabricate the shroud 203, blades 205 and the hub 204 one with another.

As a result, the turbofan for a window-type air conditioner according to the present invention, provides advantages in that, since the rotational velocity is elevated in a state wherein the size of the turbofan is decreased and operating noise is not increased in comparison with the conventional turbofan, in such a way as to effect the same air-blowing capability, miniaturization of the air conditioner is made possible and thus the value of the air conditioner is increased. Furthermore, due to the fact that it is possible to integrally fabricate a shroud, blades and a hub one with another, productivity of the turbofan is improved.

In the drawings and specification, there have been disclosed typical preferred embodiments of the present invention and, although specific terms are employed, they are used in a generic and descriptive sense only and not for purposes of limiting the scope of the invention as set forth in the following claims.

What is claimed is:

1. A turbofan for a window air conditioner, comprising:

a hub;

a plurality of blades located at a predetermined separation from the hub and gradually narrowed in their width toward the hub; and a shroud attached to the blades in opposition to the hub;

wherein an entire width of the turbofan is 35–45% of an outer diameter of the blades, an exit width of the turbofan is 50–60% of the entire width, an entrance width of the turbofan is 85–92% of the entire width, a hub-side inner diameter of the blades is 45–55% of the outer diameter of the blades, and an shroud-side inner diameter of the blades is 60–70% of the outer diameter of the blades.

2. The turbofan according to claim 1, wherein each blade has a shroud-side inclination angle of 30–60°, an exit angle of 50–65°, a hub-side entrance angle of 15–30°, a shroud-side entrance angle of 40–55°, a maximum camber position of 0.3–0.5, and a maximum thickness of 5–8% of a hub-side chord length or 7–12% of a shroud-side chord length.

3. The turbofan according to claim 2, wherein the inner diameter of the shroud is 70–80% of the outer diameter of the blades.

4. The turbofan according to claim 3, wherein seven to eleven blades are located at a predetermined separation from the hub.

5. The turbofan according to claim 4, wherein the hub has a diameter which is less than the outer diameter of the blades.

6. The turbofan according to claim 1, wherein the inner diameter of the shroud is 70–80% of the outer diameter of the blades.

7. The turbofan according to claim 1, wherein the hub has a diameter which is less than the outer diameter of the blades.

8. The turbofan according to claim 1, wherein seven to eleven blades are located at a predetermined separation from the hub.

9. The turbofan according to claim 1, wherein the hub has a diameter which is less than the outer diameter of the blades and hub-side ends of the blades extend in a direction away from said hub.

10. An air conditioner for mounting in a window, comprising:

a compressor for compressing a refrigerant;

a condenser for condensing the refrigerant from said compressor;

an evaporator; and a turbofan for circulating air through the evaporator, wherein said turbofan includes:

a hub;

a plurality of blades located at a predetermined separation from the hub and gradually narrowed in their width toward the hub; and a shroud attached to the blades in opposition to the hub;

wherein an entire width of the turbofan is 35–45% of an outer diameter of the blades, an exit width of the turbofan is 50–60% of the entire width, an entrance width of the turbofan is 85–92% of the entire width, a hub-side inner diameter of the blades is 45–55% of the outer diameter of the blades, and a shroud-side inner diameter of the blades is 60–70% of the outer diameter of the blades.

11. The air conditioner according to claim 10, wherein each blade has a shroud-side inclination angle of 30–60°, an exit angle of 50–65°, a hub-side entrance angle of 15–30°, a shroud-side entrance angle of 40–55°, a maximum camber position of 0.3–0.5, and a maximum thickness of 5–8% of a hub-side chord length or 7–12% of a shroud-side chord length.

12. The air conditioner according to claim 11, wherein the inner diameter of the shroud is 70–80% of the outer diameter of the blades.

13. The air conditioner according to claim 12, wherein seven to eleven blades are located at a predetermined separation from the hub.

14. The air conditioner according to claim 13, wherein the hub has a diameter which is less than the outer diameter of the blades.

15. The air conditioner according to claim 10, wherein the inner diameter of the shroud is 70–80% of the outer diameter of the blades.

16. The air conditioner according to claim 10, wherein the hub has a diameter which is less than the outer diameter of the blades.

17. The air conditioner according to claim 10, wherein seven to eleven blades are located at a predetermined separation from the hub.

18. The air conditioner according to claim 10, wherein the hub has a diameter which is less than the outer diameter of the blades and hub-side ends of the blades extend in a direction away from said hub.

* * * * *